United States Patent [19]

Perez et al.

[11] 4,276,755

[45] Jul. 7, 1981

[54] GAS DEFROST SYSTEM INCLUDING HEAT EXCHANGE

[75] Inventors: Arthur Perez; Fayez F. Abraham, both of Niles, Mich.

[73] Assignee: Tyler Refrigeration Corporation, Niles, Mich.

[21] Appl. No.: 952,612

[22] Filed: Oct. 18, 1978

[51] Int. Cl.[3] ..... F25B 41/00; F25B 47/00

[52] U.S. Cl. ..... 62/196 B; 62/81; 62/278; 62/513

[58] Field of Search ..... 62/81, 277, 278, 196 B, 62/196 R, 513

[56] References Cited

U.S. PATENT DOCUMENTS 3,645,109 2/1972 Quick ..... 62/196

*Primary Examiner*—Lloyd L. King

*Attorney, Agent, or Firm*—LeBlanc, Nolan, Shur & Nies

[57] ABSTRACT

A gas defrost system comprising a heat exchange assembly located in close physical proximity with a branch conduit from the compressor discharge; the branch conduit leads, through a gas manifold, to the several remote evaporators comprising the refrigeration system. Liquid refrigerant is supplied to the heat exchanger from the liquid manifold and evaporated refrigerant is returned from the heat exchanger to the suction manifold. Refrigerant flow through the heat exchanger is controlled by an externally equalized expansion valve which has sensors connected to measure the compressor discharge pressure and the defrost gas temperature downstream of the heat exchange section. The expansion valve can be preset to maintain a desired amount of heat exchange so that the temperature of the defrost gas in the manifold will be maintained at or above a predetermined lower limit.

29 Claims, 7 Drawing Figures

GAS DEFROST SYSTEM INCLUDING HEAT EXCHANGE

BACKGROUND OF THE INVENTION

1. Field of the Invention

This invention relates to closed cycle refrigeration systems and particularly to a defrost arrangement therefor. Still more particularly, the invention relates to a new and improved gas defrost arrangement for a closed cycle refrigeration system.

2. Description of the Prior Art

In a conventional closed cycle refrigeration system, gaseous refrigerant is compressed to a relatively high temperature and relatively high pressure. This compressed gaseous refrigerant is condensed to a liquid at or close to the compressor discharge pressure. The liquid refrigerant is evaporated at a substantially lower pressure in evaporating coils to accomplish the desired cooling effect at the evaporators; this evaporated refrigerant is returned to the compressor and recompressed to complete and continue the refrigeration cycle.

The refrigerant absorbs a substantial amount of heat during the evaporation stage which is dissipated by the condenser as a waste byproduct of the refrigeration cycle. Refrigerating systems employing gas defrost utilize a certain amount of this extra heat by channeling some of the hot compressed gaseous refrigerant back to the evaporators where this heat is given up by the gaseous refrigerant to defrost the evaporators.

In one type of conventional gas defrost system, the superheated gaseous refrigerant is periodically channeled directly from the compressor output into one or more selected evaporator coils to melt the frost accumulated thereon. Examples of such systems are shown in Friedman et al. U.S. Pat. No. 3,138,007 issued June 23, 1954 and Blake U.S. Pat. No. 3,150,498 issued Sept. 29, 1964.

Other conventional gas defrost systems remove the superabundance of sensible heat from the compressor discharge gas so that the defrost gas conveyed to the selected evaporator(s) to be defrosted is at or close to the saturation temperature of the refrigerant. Examples of such systems are shown in Latter U.S. Pat. No. 2,895,306 issued July 21, 1959 (heat exchange between superheated gaseous refrigerant from compressor discharge and evaporated gaseous discharge from suction side of closed system); and Quick U.S. Pat. No. 3,343,375 issued Sept. 26, 1967 (mixing of condensed liquid refrigerant with superheated gaseous refrigerant from the compressor discharge or direct use of receiver gas).

Still other prior art systems remove both superheat and latent heat from the defrosting refrigerant so that only condensed liquid refrigerant is conveyed to the evaporator to be defrosted (Decker et al., U.S. Pat. No. 3,195,321 issued July 20, 1965); still other systems increase the heat content of the defrost gas by means of external electric heaters and the like (Beckwith U.S. Pat. No. 3,147,602 issued Sept. 8, 1964).

Conventional gas defrost arrangements for closed cycle refrigeration systems generally fall into two main categories: (1) those in which superheated gaseous refrigerant approximately at or above the compressor discharge temperature is conveyed to the evaporator to be defrosted; and (2) those in which substantially all of the superheat is removed and the defrost refrigerant conveyed to the evaporator to be defrosted is substantially at saturation temperature or below saturation in condensed liquid form. Both types of known gas defrost systems have certain disadvantages.

In commercial refrigeration systems, one or more compressors (connected, for example, in parallel relation) are located, along with at least one receiver tank and associated valving and manifolding, in a central location, often referred to as the "compressor room". The condenser(s), normally of the air cooled type, are usually remotely located at the exterior of the building, at the side or on the roof, e.g. about 40 to 100 feet from the compressor room. Refrigerated case evaporator coils associated with each of a plurality of refrigerated food storage cases and the like are located remote from the compressor room at various locations within the store. Conduits of substantial length (e.g. between about 50 and 300 feet) connect each evaporator with the liquid refrigerant source in the compressor room. Thus each evaporator is connected to the closed refrigeration system by a pair of substantially long conduits; one such conduit extends between the liquid manifold and the evaporator on the high side and the other between the evaporator and the suction manifold on the low side. In refrigerating systems utilizing gas defrost, the low side conduit is connected at its compressor room end to a three-way valve which in turn has its other two ports connected to the suction manifold and to a defrost gas manifold. These connecting conduits alternately carry refrigerant in one direction in the refrigerating mode and in the opposite direction in the defrosting mode.

In known refrigerating systems employing the compressor discharge as the defrost medium, these connecting conduits can be subject to wide temperature variations; the longer conduits (e.g. in the 150–300 foot range) experience substantial thermal expansion and contraction. Failure to take such changes into account during installation of a system can result in line damage and/or breakage over a period of time. Also, the superheated defrost gas can produce undesired excess heating in the region of the evaporators whereby food products which may be located close to the evaporators may be warmed and wholly or partially defrosted themselves.

To avoid the above-mentioned problems associated with superheated gas defrosting, systems were developed whereby the temperature of the defrost gas was reduced to saturation before being conducted through the connecting conduits to the evaporator(s) to be defrosted. In commercial operations, such systems included mixing the compressor discharge gas with condensed liquid refrigerant or tapping the saturated gas in the receiver tank directly. However, in any fluid flow system in which heated fluid flows through a conduit of substantial length (such as the connecting conduits between the evaporators and the compressor room), heat is given up by the fluid as it traverses the length of the conduit so that the temperature of the fluid exiting from the conduit is measurably lower than the temperature of the fluid entering the conduit. In gas defrost systems when the temperature of the defrost gas is reduced to substantially saturation temperature in the compressor room, a substantial portion of the defrost gas will give up its latent heat as it traverses the connecting conduit so that at the evaporator end of the conduit, this substantial portion of defrost refrigerant will be in its liquid phase. The result is two-fold: (1) the condensed liquid refrigerant has only sensible heat to give up for defrosting (having fewer BTUs per pound than latent heat);

and (2) additional liquid refrigerant must be added to the system to account for this condensation and avoid excessive pressure drops in the system thereby resulting in further inefficiencies.

The above discussed disadvantages of known gas defrost systems are overcome by the present invention, which has as principal objects:

(1) The creation of an additional refrigeration load in a central refrigeration system so that a larger percentage of the system may be defrosted at one time; and (2) Reduction of the temperature of the refrigerant supplied to the defrost gas manifold to a specified temperature advantageously above saturation but well below compressor discharge temperature; and (3) Maintenance of the specified temperature during substantially the entire defrost cycle.

It is a further object of the invention to provide a gas defrost system for a closed cycle refrigeration system which is capable of absorbing excess liquid refrigerant introduced into the refrigeration cycle during the defrosting of one evaporator or section of evaporators.

It is a still further object of the invention to provide a heat exchange arrangement whereby excess heat may be removed from compressor discharge gas in an amount sufficient to reduce the temperature thereof to a specified amount above the saturation temperature of that refrigerant at about the compressor discharge pressure such that the temperature differential above saturation will remain substantially constant through variations in the compressor discharge pressure.

The above and other objects of the present invention are incorporated into a multiple refrigerating system involving two or more evaporators in which the compressor is remote from the evaporators and less than all of the evaporators are defrosted at a given time.

SUMMARY OF THE INVENTION

The gas defrost system of the present invention comprises a heat exchange coil assembly located in close physical proximity with a branch conduit from the compressor discharge which leads, through a gas manifold, to the several remote evaporators comprising the refrigeration system. For convenience, in the commercial embodiment, liquid refrigerant is supplied to the high side of the heat exchanger from the liquid manifold and evaporated refrigerant is returned from the low side of the heat exchanger to the suction manifold.

Refrigerant flow through the heat exchanger is controlled by an externally equalized expansion valve which has sensors connected to measure the compressor discharge pressure (saturation temperature of a refrigerant is a direct function of compressor discharge pressure) and the defrost gas temperature downstream of the heat exchange section. The expansion valve can be preset to maintain a desired amount of heat exchange so that the temperature of the defrost gas in the manifold will be maintained at or above a predetermined lower limit, preferably above saturation temperature.

To avoid returning condensed liquid refrigerant to the suction side of the system and thus the compressor, means are provided to prevent excessively low temperature gases or liquid refrigerant from being returned to the suction side of the system. One such means comprises a thermostatically controlled solenoid valve which shuts off refrigerant flow through the heat exchanger when the temperature of the refrigerant in the heat exchange return conduit falls below a preset valve.

An alternative means for preventing liquid refrigerant from being returned to the suction side of the system is the use of an EPR (Evaporator Pressure Regulator) valve in the heat exchange return conduit. This valve by itself will with a single pressure setting be able to prevent temperature in the suction system from dropping below its preset value.

A second embodiment of the invention combines the heat exchange principal with mixing of gases at different temperatures to achieve the same desired result. In particular, one portion of the superheated compressor discharge gas is subject to heat exchange whereby the temperature of this portion of the discharge gas may be reduced a desired amount; a second portion of the compressor discharge gas by-passes the heat exchanger and is mixed downstream of the heat exchanger with the reduced temperature discharge gas. The resultant mixture will be a gaseous refrigerant having a pressure substantially the same as the compressor discharge pressure and a temperature between the temperatures of and in proportion to the relative amounts of the separate gaseous portions.

This second embodiment is particularly advantageous under certain conditions where it is easier to control the operation of an expansion valve which measures the temperature and pressure of that refrigerant flowing through it rather than controlling the heat exchanger refrigerant flow by measuring the temperature and pressure of the defrost gas flow; under such conditions this alternative embodiment permits greater control over the defrost gas temperature during transient and steady state periods.

Other features and advantages of this invention will be apparent from the following detailed description.

DESCRIPTION OF THE PREFERRED EMBODIMENT

The preferred embodiment of this invention is described hereunder with reference to a commercial refrigeration system manufactured by Tyler Refrigeration Corporation, assignee of this application, under the tradename "SCOTCH TWOSOME" and described in detail in Tyler Installation and Service Manual for Scotch Twosome Condensing Unit Assemblies Rev. 5/78. It is understood that the invention is not limited to the Scotch Twosome assembly; the invention is applicable to any closed cycle refrigeration system capable of incorporating a gas defrost arrangement.

Figure 1:
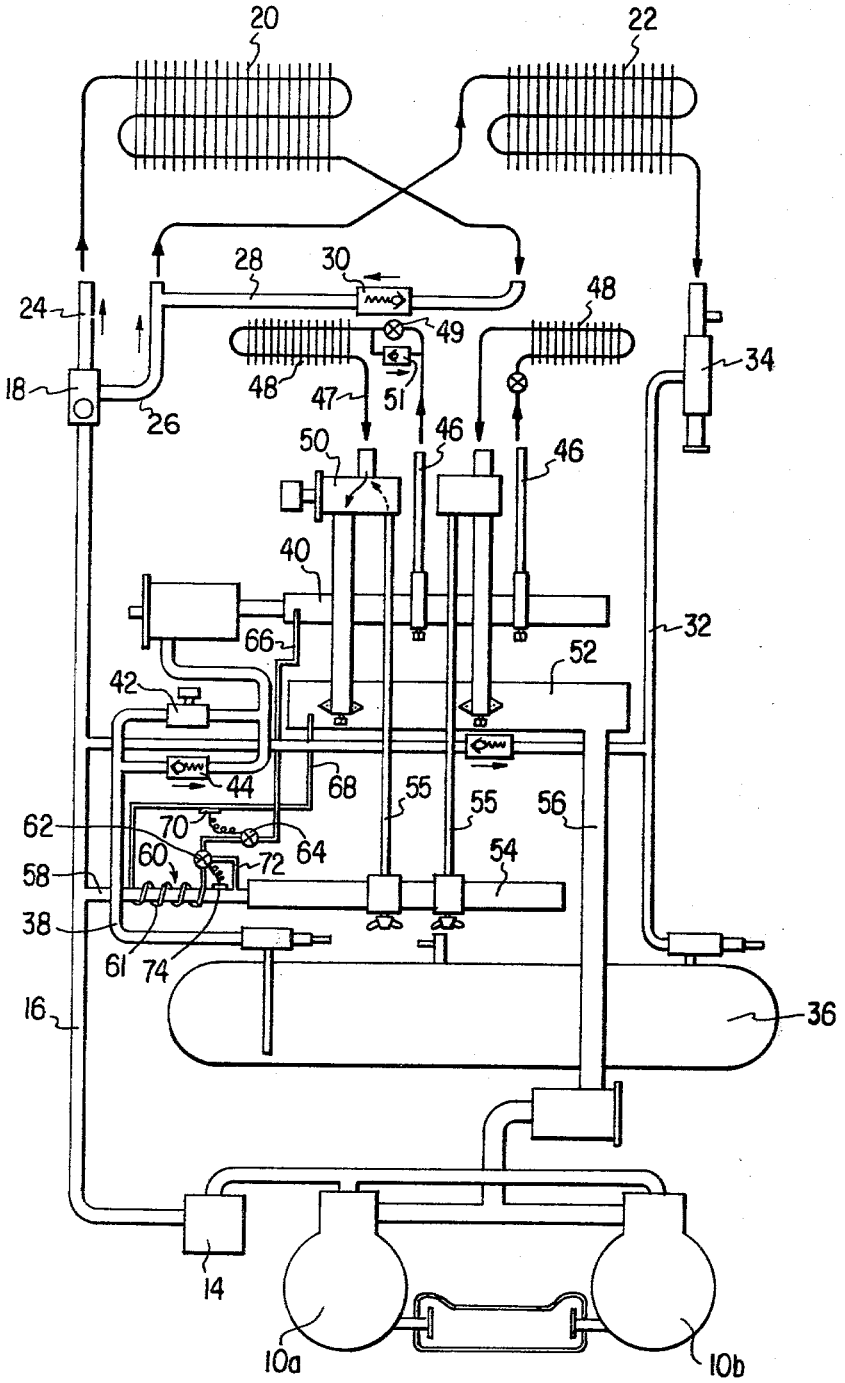
FIG. 1 is a schematic piping diagram of a typical closed cycle refrigeration system incorporating the heat exchange gas defrost arrangement of this invention to produce a controlled temperature defrost gas.

FIG. 1 shows a Scotch Twosome assembly incorporating the gas defrost system of this invention. To avoid unnecessary and extraneous disclosure, only those portions of the Scotch Twosome system shown in FIG. 1 as are pertinent to the present invention are described in detail below.

Throughout this description, references to "high side" are to the high pressure side of the system (upstream of the metering device) or portion thereof; references to "low side" are to the low pressure side of the system (downstream of the metering device) or portion thereof. Also, the liquid side of the system is generally considered to be between the outlet of the condenser and the metering device; the low pressure gas side or "suction side" lies between the metering device and the compressor.

A conventional refrigeration system as exemplified by the Scotch Twosome assembly of FIG. 1 comprises one or more compressors 10; the Scotch Twosome unit, for example, incorporates a pair of compressors 10A and 10B connected in parallel. The compressor discharge is connected (through an oil separator 14 if desired) to the main compressor discharge gas conduit 16. A solenoid operated heat recovery valve 18 may advantageously be interposed in conduit 16 to selectively connect a heat recovery coil 20 in series flow relation with a remote condenser 22. Valve 18 connects conduit 16 to the upstream side of coil 20 through a heat recovery branch conduit 24; valve 18 connects conduit 16 to the upstream side of remote condenser 22 through a remote condenser branch conduit 26. The downstream side of heat recovery coil 20 is connected to branch conduit 26 by a conduit 28 containing a check valve 30.

The downstream side of remote condenser 22 is connected through a conduit 32 and pressure regulator valve 34 to a receiver tank 36. A liquid line 38 connects the liquid phase of receiver 36 with a liquid manifold 40 through a main liquid solenoid valve 42 and parallel connected check valve 44. One or more liquid lines 46 connect the liquid manifold 40 to each of one or more remotely located evaporators 48 associated, for example, with respective refrigerated display cases or cold rooms, generally in a store such as a supermarket. The (normally) downstream side of each evaporator 48 is connected through a corresponding evaporator return line 47 and a threeway gas defrost valve 50 to a suction manifold 52 and a defrost gas manifold 54. Suction manifold 52 is connected through a suction conduit 56 to the intake of compressor(s) 10. A branch conduit 58 connects defrost gas manifold 54 with main compressor discharge gas conduit 16.

The components thus far described are all conventional. Except for heat recovery coil 20, remote condenser 22, evaporators 48 and their associated connecting conduits 46, 47, all of the above described components may advantageously form part of a unitary package mounted to a main frame or rack located in the "compressor room" of the store. As is well known, the respective display cases containing evaporators 48 are located at convenient places throughout the public area of the store; connecting conduits 46 and 47 may therefore be between about 50 and 300 feet in length. Remote condenser 22 is usually located on the roof of the store e.g., between about 40 and 100 feet from the compressor room; and the heat recovery coil is located in the store air handler system where it can give up heat to the store air circulation system, as desired.

The present invention comprises a gas defrost arrangement having component parts described below which are advantageously incorporated into the rack or frame mounted assembly described above. Referring in particular to FIG. 1, a heat exchange coil assembly 60 is located in heat exchange relation with branch conduit 58 and in general comprises a heat exchange coil 61 located around and over at least a portion of branch conduit 58 between the main compressor discharge conduit 16 and the defrost gas manifold 54. The upstream side of the heat exchange coil assembly 60 is connected through an externally equalized expansion valve 62 and a thermostatically controlled solenoid valve 64 to the liquid manifold 40 by a supply conduit 66. The downstream side of the heat exchange coil assembly 60 is connected to the suction manifold 52 by a return conduit 68. Advantageously and preferably, heat exchange coil assembly 60 is connected in counterflow relation to branch conduit 58. (By counterflow is meant that the direction of fluid flow in the heat exchange coil is opposite that in the compressor discharge branch conduit 58; e.g., in FIG. 1, refrigerant flows through the heat exchange coil 61 from right to left, whereas refrigerant flows through the branch conduit 58 from left to right.)

The solenoid valve 64 is thermostatically controlled through a temperature sensing feeler bulb 70 coupled to the low side return conduit 68 between heat exchange coil assembly 60 and suction manifold 52. Valve 64 may also be provided with an override mechanism which closes the valve to shut off refrigerant flow through the heat exchanger when no defrosting is called for in any evaporator.

The refrigerant flowing through the branch conduit 58 gives up heat to the heat exchange coil assembly 60 in an amount which may be controlled by the refrigerant flowing through the coil assembly 60. Refrigerant flow through the heat exchange coil 61 is controlled by the expansion valve 62. The expansion valve is controlled by the detected pressure and temperature of the branch conduit between the heat exchange coil assembly 60 and the defrost gas manifold 54; the expansion valve 62 is connected to the branch conduit 58 through a pressure equalizing line sensing tube 72 and a temperature sensing feeler bulb 74. The expansion valve minimum set point is determined by the pressure measured by equalizing line 72. Maintenance of the defrost gas temperature between the heat exchanger 60 and defrost gas manifold 54 at or above the minimum set point is a function of the temperature measured by the feeler bulb 74 controlling the expansion valve 62. Temperature sensor 74 should be located between coil assembly 60 and defrost gas manifold 54 or at manifold 54 to measure the temperature of the compressor discharge gas after heat has been removed by coil assembly 60. Pressure sensing line 72 may be located anywhere in the compressor discharge circuit but is preferably and advantageously located in close proximity with temperature sensor 74; this reduces measurement disparities due to system dynamics.

The externally equalized expansion valve 62 therefore controls the flow of refrigerant through the heat exchange coil assembly 60 as a function of the temperature and pressure measured in the branch conduit 58, preferably at or close to the defrost gas manifold 54. In this way, a continuous monitor and control system is provided whereby refrigerant flow through the heat exchange coil is metered to maintain a desired temperature of defrost gas refrigerant at the defrost gas manifold.

If the temperature of the refrigerant leaving the heat exchanger 60 falls below a predetermined limit, the solenoid valve 64 closes as a function of temperature measured by its feeler bulb 70. This prevents liquid refrigerant from entering the suction manifold with a possibility that such liquid may be drawn into the compressor. Closing the solenoid valve 64 shuts off refrigerant flow through the heat exchange coil assembly 60, thereby causing the temperature of the defrost gas refrigerant in manifold 54 to rise toward the compressor discharge temperature, and raises the temperature of the refrigerant being returned to the suction manifold.

In the normal refrigeration cycle, compressor 10 compresses gaseous refrigerant to a relatively high superheat temperature (called "compressor discharge temperature") at a relatively high pressure (called "compressor discharge pressure"). The specific compressor discharge temperature and pressure ranges are a function of the refrigerant, number and type of condensers, and the size of the components in general. Typical compressor discharge temperatures of a Scotch Twosome system using refrigerant R-502 may range from 225° F.–250° F. for a compressor discharge pressure range of 150–250 p.s.i.; for a system employing R-12, the compressor discharge temperature will typically be 170° F.–200° F. at pressures of 80–140 p.s.i.

During the normal refrigeration cycle, gas defrost valves 50 are set to connect the low side of evaporator 48 with suction manifold 52, the flow path between defrost gas manifold 54 and evaporator 48 being shut off by valve 50. The compressed gaseous refrigerant is condensed in remote condenser 22 alone or in series with heat recovery coil 20. The condensed liquid refrigerant flows through conduit 32 into receiver 36 where it is held at substantially the compressor discharge pressure.

Liquid refrigerant from the receiver 36 flows through conduit 38 and liquid manifold 40 to evaporators 48. An expansion valve 49 and check valve 51 are connected in parallel to the evaporator 48. In known manner, liquid refrigerant is conducted by branch conduit 46 to evaporator 48 through expansion valve 49 which expands the liquid refrigerant flowing through the evaporator to a substantially lower pressure than the compressor discharge pressure. Each expansion valve 49 is controlled in a conventional manner by sensing means for properly controlling the expansion of refrigerant into the evaporator coil.

The evaporated refrigerant is returned from the evaporator coil 48 through three-way valve 50 to suction manifold 52 and then through suction conduit 56 to the intake of compressor 10. Thus far, a conventional closed refrigeration system has been described.

Periodically it becomes necessary to defrost the several evaporators. A conventional control circuit (not shown) is used to select the evaporator or evaporators to be defrosted at a given time. When the control circuit selects a particular evaporator to be defrosted, the associated gas defrost valve 50 is activated to connect the low side of evaporator 48 with the defrost gas manifold 54 and close off the flow path to suction manifold 52.

A portion of the compressed gaseous refrigerant at the compressor discharge temperature and pressure thereupon flows through branch conduit 58, where its temperature is reduced by heat exchange with coil assembly 60, while remaining at or substantially at the compressor discharge pressure; the reduced temperature defrost gas then flows through defrost gas manifold 54, connecting branch conduit 55 and gas defrost valve 50 to evaporator 48. In the evaporator, the defrost gas gives up heat to warm and thereby defrost the evaporator coils. In so doing, most or all of the defrost gas is condensed; the liquid refrigerant then flows through check valve 51 (expansion valve 49 is closed to reverse flow of refrigerant), branch conduit 46 and into liquid manifold 40 where it mixes with the liquid refrigerant being supplied to the remaining evaporator coils in the refrigeration cycle.

Figure 2:
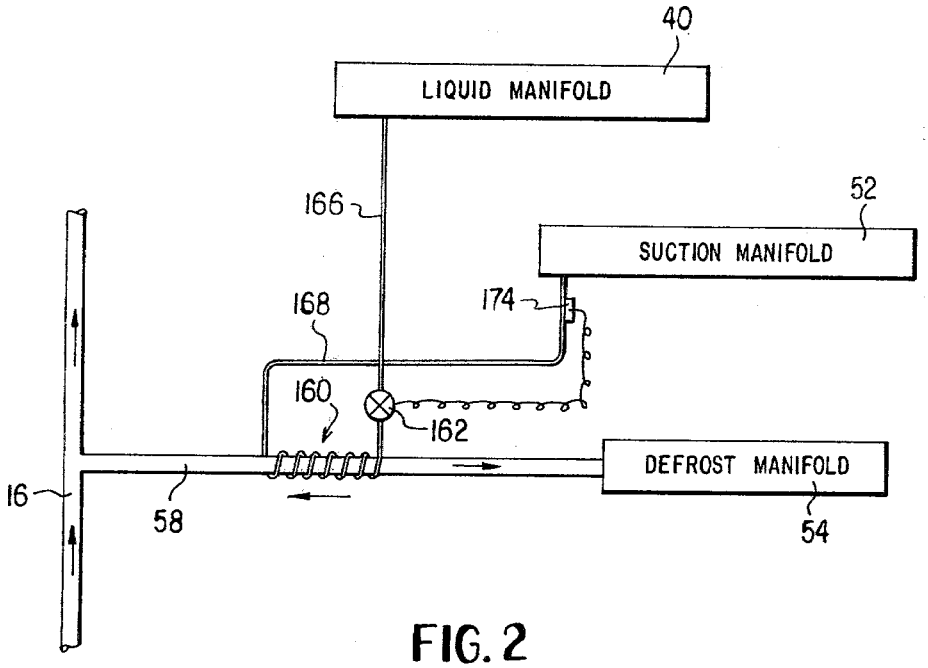
FIG. 2 shows a first modified version of the gas defrost arrangement of this invention.

Variations on the above described preferred heat exchange arrangement are shown in FIGS. 2–6. FIG. 2 shows a counterflow heat exchange coil assembly 160 with a thermostatically controlled expansion valve 162 interposed in supply conduit 166. The temperature measuring feeler bulb 174 is located on the return conduit 168. This arrangement has a relatively high efficiency, but gives relatively low control of the temperature of the defrost gas passing to manifold 54.

Figure 3:
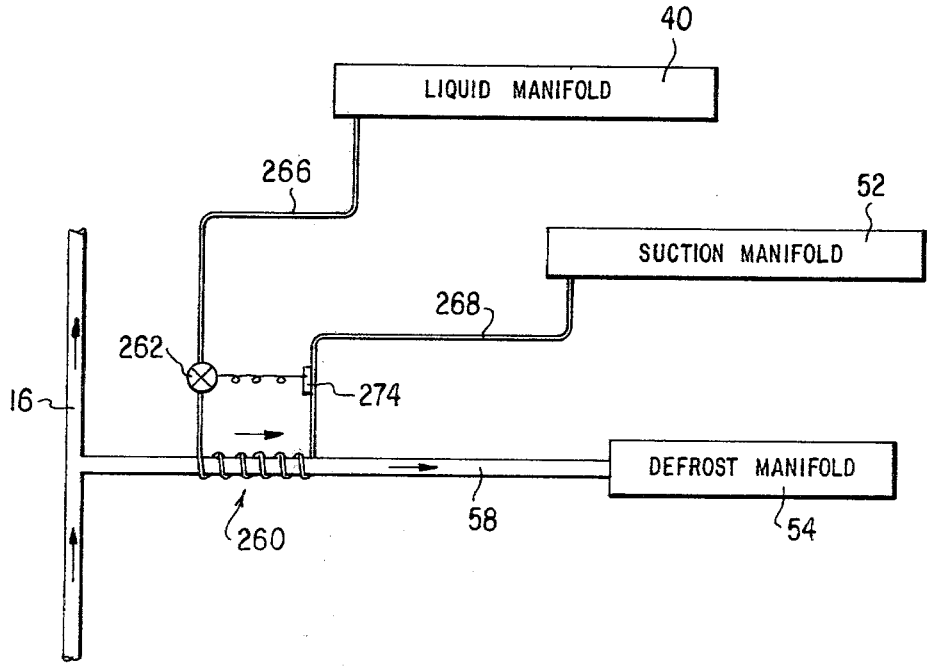
FIG. 3 shows a second modified version of the gas defrost arrangement of this invention.

FIG. 3 illustrates a similar system as shown in FIG. 2 with the heat exchange coil assembly 260 in parallel relation with branch conduit 58. By parallel relation is meant that the refrigerant flow through heat exchange coil assembly 260 is in the same direction (i.e. left to right in FIG. 3) as the refrigerant flow in branch conduit 58. This arrangement provides better temperature control of the defrost gas at manifold 54 because the temperature of the refrigerant measured by sensor 274 is more closely related to the temperature of the defrost gas in branch conduit 58 exiting from coil assembly 260 than is the case with the arrangement of FIG. 2.

Figure 4:
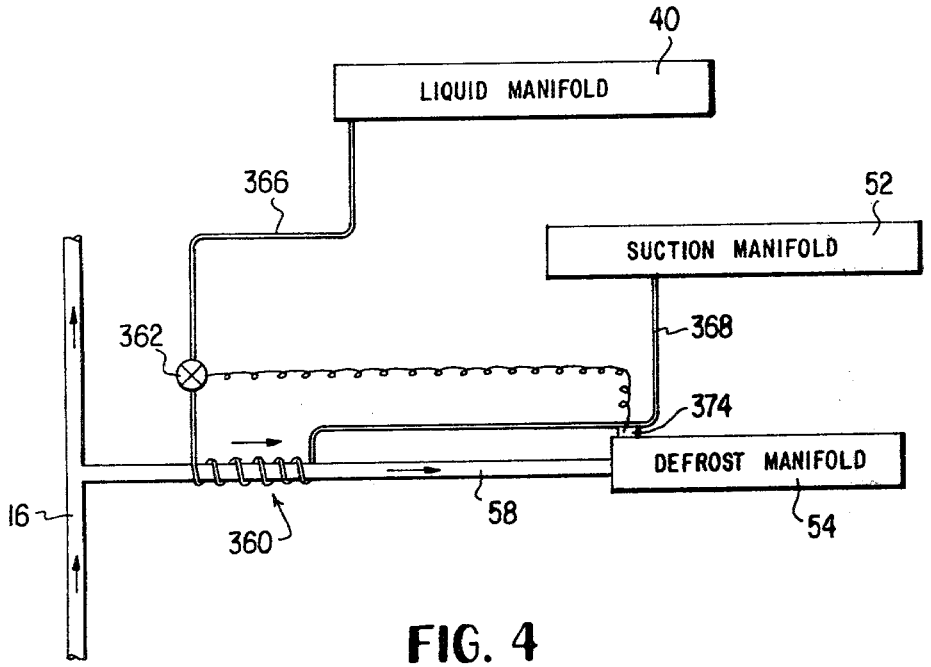
FIG. 4 shows a third modified version of the gas defrost arrangement of this invention.

FIG. 4 shows a similar arrangement as FIG. 3 except that the temperature sensing feeler bulb 374 is arranged to measure the temperatures of the gaseous refrigerant in return conduit 368 and in defrost manifold 54 (or branch conduit 58) simultaneously. By this arrangement, the expansion valve 362 will be controlled as a function of the average of the refrigerant temperatures in conduit 368 and manifold 54.

Figure 5:
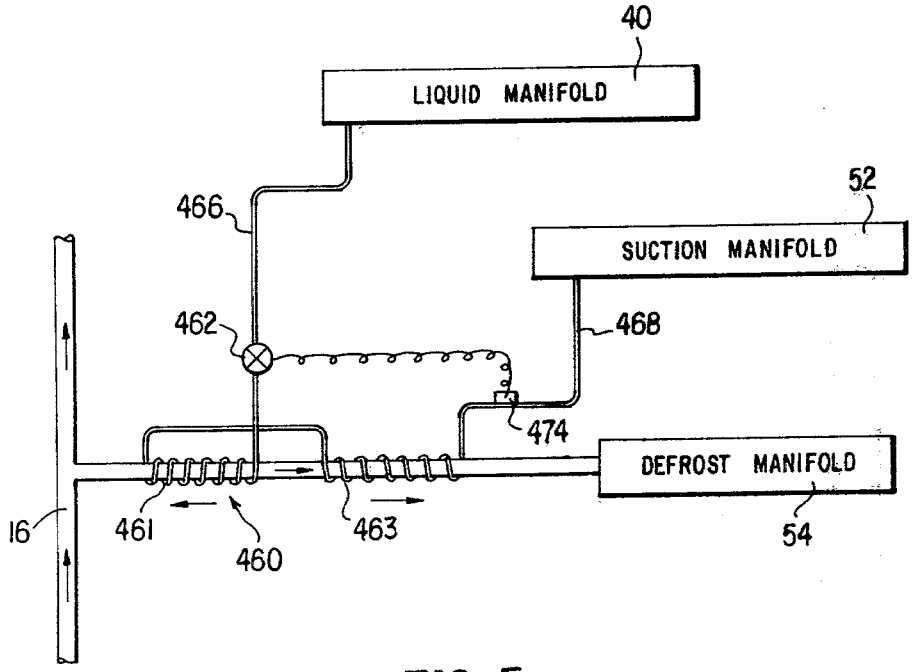
FIG. 5 shows a fourth modified version of the gas defrost arrangement of this invention.

FIG. 5 discloses a combination flow arrangement comprising a first counterflow heat exchange coil 461 and a second parallel flow coil 463; the latter is located downstream (in the direction of flow of refrigerant through branch conduit 58) from the former. The counterflow coil provides the maximum efficiency in heat exchange while the parallel flow coil permits equalization of the refrigerant temperatures so that the temperature of refrigerant in return conduit 463 measured by sensor 474 is relatively close to the temperature of defrost gas refrigerant entering manifold 54.

Figure 6:
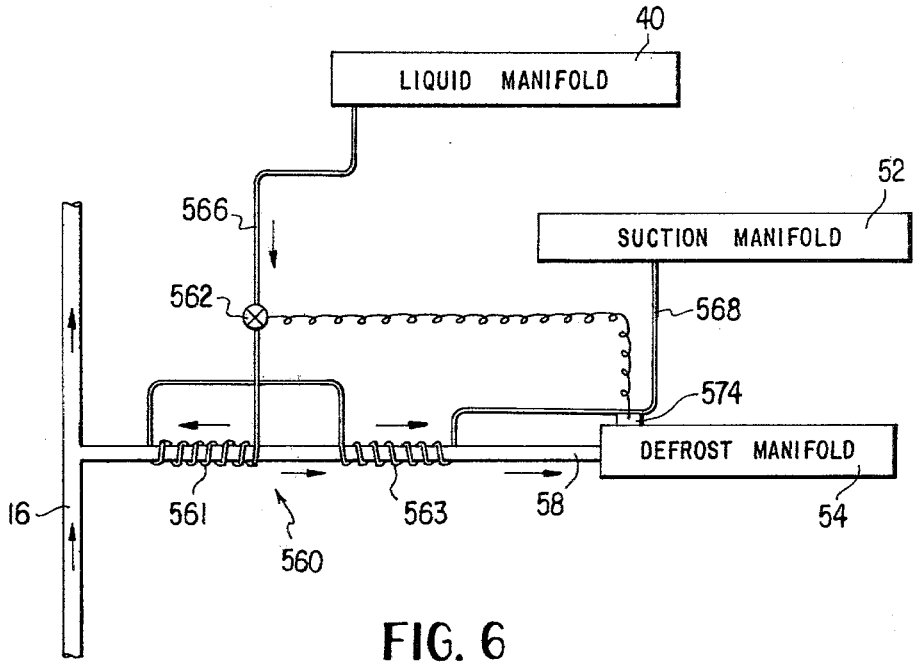
FIG. 6 shows a fifth modified version of the gas defrost arrangement of this invention.

FIG. 6 shows a similar arrangement as FIG. 5 except that the sensor 574 is disposed to concurrently measure refrigerant temperatures in return conduit 568 and defrost manifold 54 (or branch conduit 58 close to manifold 54). System control is similar to the arrangement of FIG. 4.

Figure 7:
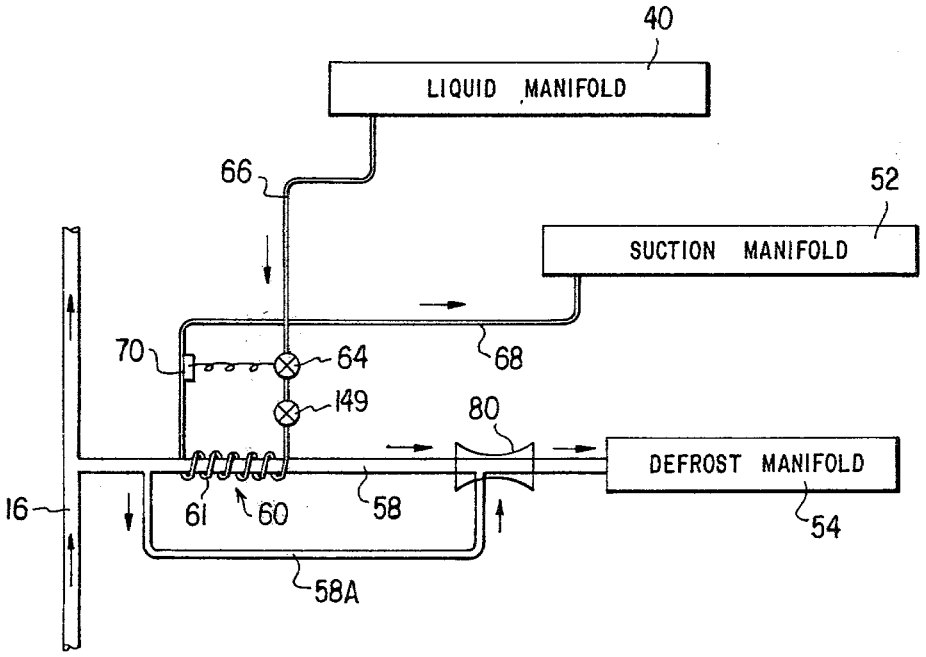
FIG. 7 shows a still further embodiment combining heat exchange and gas mixing features to produce a controlled temperature defrost gas.

FIG. 7 shows a further embodiment of the invention in which heat exchange and injection are combined to give the greater temperature control of the defrost gas under certain operating conditions. In this embodiment, expansion valve 62 may be advantageously and preferably replaced by an expansion valve 149 which is similar in construction and mode of operation to valves 49 associated with evaporators 48. A T-connection or venturi (or like mixer) 80 is interposed in branch conduit 58 between the heat exchange coil assembly 60 and defrost gas manifold 54. A branch conduit 58A bypasses heat exchange coil assembly 60 and connects the compressor discharge to a part of mixer 80. By this arrangement, it will be seen that one portion of the compressor discharge gas will pass through the heat exchanger 60 whereby its temperature will be reduced a desired amount. This reduced temperature portion is then mixed with a second portion of the compressor discharge at the compressor discharge temperature; the temperature of the resultant gaseous mixture will lie between the relatively high temperature of the injected gas from bypass conduit 58A and the relatively lower temperature of heat exchanged gas in conduit 58.

For example, if conduits 58 and 58A are so sized and/or their branching and/or mixing connections are so shaped that equal amounts of the first and second portions of gas are mixed in mixer 80, and if the temperature of the compressor discharge gas is approximately 200° F. and the temperature of the heat exchanged gas in conduit 58 is approximately 100° F., the temperature of the defrost gas entering manifold 54 will be approximately 150° F. Naturally, the relative amounts in which the reduced temperature portion and compressor discharge portion are mixed will determine the temperature of the gas mixture in manifold 54.

This arrangement has advantages under certain operating conditions. Since expansion valve 149 is internally controlled on the basis of the temperature and pressure of refrigerant flow through heat exchange coil 61, it is less susceptible to difficulties in measuring the temperature and pressure of the defrost gas in branch conduit 58 downstream of the heat exchanger 60. Control of heat exchange is easily established because it takes place in the predictable sensible heat range above saturation temperature.

It is to be noted that any other metering device which produces the desired heat exchange temperature control effect could be used in the embodiments of FIGS. 1–7 in place of the particular expansion valves described.

It will be appreciated that the injection feature can be utilized with any of the heat exchangers shown in FIGS. 1–6.

The invention described here in its various embodiments constitutes an advantageous arrangement over previously known gas defrost systems. One such advantage lies in the fact that the heat exchanger of this invention creates an additional refrigerant load which increases the percentage of the total system which may be defrosted at any one time. The present invention provides for a direct use of the liquid refrigerant in the main system to supply the expansion valve of the heat exchanger. This in effect creates an additional refrigerant load to absorb liquid refrigerant produced during a defrost operation as the evaporator being defrosted returns liquid refrigerant to the system.

The benefit of this arrangement lies in the fact that multiplex refrigerating systems with gas defrosting are limited as to the percentage of the total refrigerating system which may be in the defrost mode at any one time. This is because of (1) the limited availability of total heat in the system and (2) limitations on the availability of the system to absorb condensed liquid refrigerant from the evaporators being defrosted. It has heretofore been a general rule of thumb in the industry that no more than about 25% of the total capacity of the refrigerating system (generally measured in BTU's) can be defrosted at any one time. It is considered that with the present invention in its various modes, as much as 30% to 33% of the system may be defrosted at one time. Thus, for example, in a typical commercial refrigerating system having a capacity of about 300,000 BTUs, this can amount to a 25,000 BTU increase in defrosting capability. One advantage of this is a decrease in installation and maintenance costs due to the reduced amount of piping necessary.

A further advantage of the present invention in its various embodiments lies in the ability of the herein disclosed defrost arrangement to achieve and maintain over a long period of time a desired defrost gas temperature. Advantageously and preferably, such temperature lies between saturation temperature of the particular refrigerant used in the system and its compressor discharge temperature.

In prior art systems of the so-called "hot-gas" type in which the defrost gas was taken directly from the compressor discharge at the relatively high discharge temperature there was always the problem of exposing the piping between the compressor room rack mounted equipment and the remote evaporator (which could be on the order of 50 to 300 feet) to excessive thermal change, causing large dimensional changes in the relatively long pipes. This required careful mounting and supporting of the pipe connections to take into account such expansion and contraction of the pipe. Unless the pipe installations were carefully made, pipe breakage could become and sometimes was a problem.

One solution to the problems associated with "hot gas" defrost arrangements called for reducing the temperature of the defrost gas to the saturation temperature of the refrigerant before conducting that refrigerant through the relatively long conduits to the remote evaporators for defrosting same. As a practical matter, however, it is often undesirable to cool the defrost gas to substantially saturation temperature before conducting it to the remote evaporator in view of the inherent tendency of a fluid to give off heat as it traverses a relatively long flow path. What starts out as substantially all saturated gaseous refrigerant may end up in large part as condensed liquid refrigerant before it reaches the evaporator. In that event, a substantial portion of the defrosting will be accomplished only by the sensible heat available in the liquid refrigerant which has less heat content than the latent heat available in the gaseous refrigerant. Thus the defrosting will be less efficient if a substantial portion of the defrost refrigerant is in condensed liquid form.

The present invention avoids the aforementioned problems or potential difficulties associated with prior art gas defrost systems. The heat exchange system of the present invention can be set to remove a substantial amount of the "superheat" in the compressor discharge refrigerant to substantially reduce the amount of thermal expansion in the connecting conduits during defrost.

At the same time, the system can be adjusted to maintain the temperature of the defrost gas entering the defrost gas manifold at a desired temperature differential above the saturation temperature of that refrigerant. For example, maintaining the defrost gas at the manifold about 30° F. above saturation temperature overcomes the above noted disadvantages and/or problems associated with prior art systems. The 30° differential means that 30° of sensible heat can be given up to the connecting conduit between the manifold 54 and the evaporator 48 to be defrosted; thus, most or all of the defrost refrigerant reaching the evaporator 48 can be expected to be at or above saturation temperature (and not condensed) so that the substantial amount of heat energy contained in the latent heat of the defrost gas is available for defrosting.

It should be noted that variations in construction can be made without affecting the operation of the defrosting arrangement of this invention. For example, the liquid refergerant supply to heat exchange coil assembly 60 can be connected anywhere in the liquid portion of the refrigeration system (e.g. anywhere between the remote condenser 22 and liquid manifold 40); similarly, heat exchange conduit 68 may be connected anywhere in the suction side of the system (e.g. between suction manifold 52 and intake of compressor 10).

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced herein.

What is claimed and desired to be secured by United States Letters Patent is:

1. A defrosting arrangement for a refrigeration system having compressor means for compressing a refrigerant to a relatively high compressor discharge pressure, condenser means for condensing that compressed refrigerant to a liquid at substantially that relatively high pressure, evaporator means coupled between said condenser means and said compressor means to accomplish the desired normal refrigeration by evaporating that liquid refrigerant at a relatively low pressure and returning the thus formed gaseous refrigerant to the intake of the compressor means as a substantial heat load, said defrosting arrangement comprising:

defrost conduit means for selectively conducting gaseous refrigerant from the compressor discharge to the evaporator means for defrosting that evaporator means;

heat exchange means coupled between the liquid side and the suction side of the refrigeration system and in heat exchange relation with said defrost conduit means for removing heat from hot refrigerant gas passing through said defrost conduit means to the evaporator means, said heat exchange means acting as an additional load to absorb liquid refrigerant produced by the defrosting of said evaporator means; and means for shutting off refrigerant flow through said heat exchange means when the evaporated refrigerant at the outlet thereof reaches a predetermined temperature.

2. A defrosting arrangement according to claim 1, wherein said heat exchange means comprises:

heat exchange coil means located in close physical proximity and in counterflow relation with said defrost conduit means; and means coupling the heat exchange coil means between the liquid side and the suction side of the refrigeration system, whereby liquid refrigerant is evaporated in said heat exchange coil means to remove heat from gaseous refrigerant in said defrost conduit means to thereby reduce the temperature of the gaseous refrigerant in the defrost conduit means to a relatively low temperature before said gaseous refrigerant is conducted to the evaporator means to defrost same.

3. A refrigerating system comprising:

compressor means for compressing gaseous refrigerant to a relatively high temperature at a relatively high pressure;

condenser means coupled to said compressor means for condensing said gaseous refrigerant to a liquid at said high pressure;

a plurality of evaporator means coupled in parallel for evaporating said liquid refrigerant at a relatively low pressure which is substantially lower than said high pressure;

suction means for returning evaporated refrigerant from said evaporator means to said compressor means;

defrost conduit means coupled to said compressor means for conducting gaseous refrigerant from said compressor means to said evaporator means at said high pressure;

means for selectively connecting the low side of at least one of the evaporator means to one of said suction means and defrost conduit means depending on whether said at least one evaporator means is selected to be in a refrigerating mode or defrosting mode, respectively; and heat exchange means for reducing the temperature of the gaseous refrigerant in said defrost conduit means to a relatively low temperature substantially below the relatively high temperature of the gaseous refrigerant at the compressor discharge and at said high pressure, said heat exchange means including;

heat exchange coil means located in close physical proximity to at least a portion of said defrost means, and means coupling said heat exchange coil means across said evaporator means between the condenser means and the suction means, whereby liquid refrigerant is evaporated in said heat exchange coil means to remove heat from gaseous refrigerant in said defrost conduit means and reduce the temperature of said gaseous refrigerant to said relatively low temperature before said gaseous refrigerant is conducted to the selected evaporator means to defrost same.

4. A defrosting arrangement according to claim 3, wherein said heat exchange coil means is located in close physical proximity and in counterflow relation with said defrost conduit means.

5. A defrosting arrangement according to claim 1, wherein said shut off means comprises:

further temperature measuring means for measuring the temperature of the refrigerant at the outlet of the heat exchange means; and temperature responsive valve means coupled to said further temperature measuring means, wherein said valve means closes to shut off refrigerant flow through the heat exchange means when the measured temperature of the refrigerant at the outlet thereof falls below a predetermined temperature.

6. A defrosting arrangement according to claim 1, wherein said heat exchange means comprises:

heat exchange coil means including a first heat exchange coil located in close physical proximity to and in counterflow relation with said defrost conduit means and a second heat exchange coil coupled in series with and downstream of the first heat exchange coil and located in close physical proximity to and in parallel flow relation with said defrost conduit means downstream of said first heat exchange coil; and means coupling the heat exchange coil means between the liquid side and the suction side of the refrigeration system, whereby liquid refrigerant is evaporated in said heat exchange coil means to remove heat from gaseous refrigerant in said defrost conduit means to thereby reduce the temperature of the gaseous refrigerant in the defrost conduit means to a relatively low temperature before said gaseous refrigerant is conducted to the evaporator means to defrost same.

7. A defrosting arrangement according to claim 1, wherein said heat exchange means comprises:

heat exchange coil means located in close physical proximity and in parallel flow relation with said defrost conduit means; and means coupling the heat exchange coil means between the liquid side and the suction side of the refrigeration system, whereby liquid refrigerant is evaporated in said heat exchange coil means to remove heat from gaseous refrigerant in said defrost conduit means to thereby reduce the temperature of the gaseous refrigerant in the defrost conduit means to a relatively low temperature before said gaseous refrigerant is conducted to the evaporator means to defrost same.

8. A defrosting arrangement according to claim 6 or 7, further comprising means for regulating the flow of refrigerant through said heat exchange coil means to thereby control the amount of heat removed from the gaseous refrigerant by said heat exchange coil means.

9. A defrosting arrangement according to claim 8, wherein said refrigerant flow regulating means comprises:

thermostatically controlled expansion valve means coupled to the high side of the heat exchange coil means; and temperature sensing means coupled to said valve means for sensing the temperature at the downstream side of each of the heat exchange coil means and the defrost conduit means at substantially the same time to thereby control said valve means as a function of the combined sensed temperatures.

10. In a refrigeration system having compressor means, condenser means and evaporator means and including the normal refrigeration process of:

compressing gaseous refrigerant to a relatively high compressor discharge temperature and relatively high compressor discharge pressure, said compressor discharge temperature being substantially above saturation temperature of that refrigerant at the compressor discharge pressure;

condensing the compressed gaseous refrigerant to a liquid at substantially said compressor discharge pressure;

evaporating the liquid refrigerant at a substantially lower pressure than the compressor discharge pressure; and returning the evaporated refrigerant to the compressor to complete the normal closed cycle refrigeration process;

an improved defrosting method, comprising the steps of:

evaporating a portion of the liquid refrigerant in heat exchange relation with a portion of the gaseous refrigerant from the compressor discharge to reduce the temperature of said gaseous refrigerant portion substantially below said compressor discharge temperature at substantially the compressor discharge pressure;

controlling the flow of said liquid refrigerant portion in heat exchange relation to maintain said gaseous refrigerant portion at or above a desired temperature differential with the saturation temperature of that refrigerant at the compressor discharge pressure;

selectively passing said reduced temperature gaseous refrigerant portion through said evaporator means to defrost same by giving up heat to said evaporator means; and thereafter returning that refrigerant portion to the normal refrigeration cycle.

11. A method according to claim 10, further comprising the steps of:

evaporating a portion of the liquid refrigerant downstream of said condenser means in heat exchange relation with a branch conduit means connecting the compressor discharge with the suction side of the evaporator means through a selective control means which selectively connects the evaporator means to either the compressor intake or said branch conduit means;

returning said evaporated refrigerant portion to the suction side of the refrigeration system; and returning said reduced temperature gaseous refrigerant portion to the liquid side of the normal refrigeration system after said reduced temperature portion has passed through said evaporator means during a defrost cycle.

12. A method according to claim 10, further comprising: controlling the flow of said liquid refrigerant portion in heat exchange relation to maintain said gaseous refrigerant portion at least 30° F. above the saturation temperature of that refrigerant at the compressor discharge pressure.

13. A defrosting arrangement for a refrigeration system having compressor means for compressing a refrigerant to a relatively high compressor discharge pressure, condenser means for condensing that compressed refrigerant to a liquid at substantially that relatively high pressure, evaporator means coupled between said condenser means and said compressor means to accomplish the desired normal refrigeration by evaporating that liquid refrigerant at a relatively low pressure and returning the thus formed gaseous refrigerant to the intake of the compressor means as a substantial heat load, said defrosting arrangement comprising:

defrost conduit means for selectively conducting gaseous refrigerant from the compressor discharge to the evaporator means for defrosting that evaporator means;

heat exchange means coupled between the liquid side and the suction side of the refrigeration system and in heat exchange relation with said defrost conduit means for removing heat from hot refrigerant gas passing through said defrost conduit means to the evaporator means, said heat exchange means acting as an additional load to absorb liquid refrigerant produced by the defrosting of said evaporator means; and means for regulating the flow of refrigerant through said heat exchange means to thereby control the amount of heat removed from the gaseous refrigerant by said heat exchange means, including:

means for measuring at least one of the temperature and pressure of the relatively low temperature gaseous refrigerant downstream of said heat exchange means, and control means coupled to said measuring means and said heat exchange means for controlling the flow of refrigerant through said heat exchange means as a function of the measured temperature and/or pressure.

14. A refrigerating system comprising:

compressor means for compressing gaseous refrigerant to a relatively high temperature at a relatively high pressure;

condenser means coupled to said compressor means for condensing said gaseous refrigerant to a liquid at said high pressure;

a plurality of evaporator means coupled in parallel for evaporating said liquid refrigerant at a relatively low pressure which is substantially lower than said high pressure;

suction means for returning evaporated refrigerant from said evaporator means to said compressor means;

defrost conduit means coupled to said compressor means for conducting gaseous refrigerant from said compressor means to said evaporator means at said high pressure;

means for selectively connecting the low side of at least one of the evaporator means to one of said suction means and defrost conduit means depending on whether said at least one evaporator means is selected to be in a refrigerating mode or defrosting mode, respectively;

heat exchange means for reducing the temperature of the gaseous refrigerant in said defrost conduit means to a relatively low temperature substantially below the relatively high temperature of the gaseous refrigerant at the compressor discharge and at said high pressure, said heat exchange means including:

heat exchange coil means located in close physical proximity to at least a portion of said defrost means, and means coupling said heat exchange coil means across said evaporator means between the condenser means and the suction means, whereby liquid refrigerant is evaporated in said heat exchange coil means to remove heat from gaseous refrigerant in said defrost conduit means and reduce the temperature of said gaseous refrigerant to said relatively low temperature before said gaseous refrigerant is conducted to the selected evaporator means to defrost same;

means for regulating the flow of refrigerant through said heat exchange means to thereby control the amount of heat removed from the gaseous refrigerant by said heat exchange means, including:

means for measuring at least one of the temperature and pressure of the relatively low temperature gaseous refrigerant downstream of said heat exchange means, and control means coupled to said measuring means and said heat exchange means for controlling the flow of refrigerant through said heat exchange means as a function of the measured temperature and/or pressure.

15. A defrosting arrangement according to claim 13 or 14, wherein said control means comprises an expansion valve having a pressure responsive control and a temperature responsive control which are respectively responsive to said measured pressure and temperature to thereby control the flow of refrigerant through and thus the heat exchange ability of said heat exchange means as a function of the measured temperature and pressure of the refrigerant.

16. A defrosting arrangement according to claim 13 or 14, further comprising:

means for shutting off refrigerant flow through said heat exchange means when the evaporated refrigerant at the low side thereof reaches a predetermined temperature.

17. A defrosting arrangement according to claim 8, wherein said shut off means comprises:

further temperature measuring means for measuring the temperature of the refrigerant at the outlet of the heat exchange means; and temperature responsive valve means coupled to said further temperature measuring means, wherein said valve means closes to shut off refrigerant flow through the heat exchange means when the measured temperature of the refrigerant at the low side thereof falls below a predetermined temperature.

18. A defrosting arrangement for a refrigeration system having compressor means for compressing a refrigerant to a relatively high compressor discharge pressure, condenser means for condensing that compressed refrigerant to a liquid at substantially that relatively high pressure, evaporator means coupled between said condenser means and said compressor means to accomplish the desired normal refrigeration by evaporating that liquid refrigerant at a relatively low pressure and returning the thus formed gaseous refrigerant to the intake of the compressor means as a substantial heat load, said defrosting arrangement comprising:

defrost conduit means for selectively conducting gaseous refrigerant from the compressor discharge to the evaporator means for defrosting that evaporator means;

heat exchange means coupled between the liquid side and the suction side of the refrigeration system and in heat exchange relation with said defrost conduit means for evaporating liquid refrigerant in said heat exchange means to remove heat from gaseous refrigerant in said defrost conduit means to thereby reduce the temperature of the gaseous refrigerant in the defrost conduit means to a relatively low temperature before said gaseous refrigerant is conducted to the evaporator means to defrost same, said heat exchange means acting as an additional load to absorb liquid refrigerant produced by the defrosting of said evaporator means; and means for mixing compressed gaseous refrigerant at said relatively high temperature with compressed gaseous refrigerant at said relatively low temperature before conducting the mixed gaseous refrigerant at a relatively moderate temperature between said relatively high and low temperatures to said evaporator means in the defrosting mode.

19. A refrigerating system comprising:

compressor means for compressing gaseous refrigerant to a relatively high temperature at a relatively high pressure;

condenser means coupled to said compressor means for condensing said gaseous refrigerant to a liquid at said high pressure;

a plurality of evaporator means coupled in parallel for evaporating said liquid refrigerant at a relatively low pressure which is substantially lower than said high pressure;

suction means for returning evaporated refrigerant from said evaporator means to said compressor means;

defrost conduit means coupled to said compressor means for conducting gaseous refrigerant from said compressor means to said evaporator means at said high pressure;

means for selectively connecting the low side of at least one of the evaporator means to one of said suction means and defrost conduit means depending on whether said at least one evaporator means is selected to be in a refrigerating mode or defrosting mode, respectively;

heat exchange means for reducing the temperature of the gaseous refrigerant in said defrost conduit means to a relatively low temperature substantially below the relatively high temperature of the gaseous refrigerant at the compressor discharge and at said high pressure, said heat exchange means including:

heat exchange coil means located in close physical proximity to at least a portion of said defrost means, and means coupling said heat exchange coil means across said evaporator means between the condenser means and the suction means, whereby liquid refrigerant is evaporated in said heat exchange coil means to remove heat from gaseous refrigerant in said defrost conduit means and reduce the temperature of said gaseous refrigerant to said relatively low temperature before said gaseous refrigerant is conducted to the selected evaporator means to defrost same; and means for mixing compressed gaseous refrigerant at said relatively low temperature before conducting the mixed gaseous refrigerant at a relatively moderate temperature between said relatively high and low temperatures to said evaporator means in the defrosting mode.

20. A defrosting arrangement according to claim 18 or 19, further comprising means for regulating the flow of refrigerant through said heat exchange means to thereby control the amount of heat removed from the gaseous refrigerant by said heat exchange means.

21. A defrosting arrangement according to claim 18 or 19, wherein said mixing means comprises bypass conduit means connected to said defrost conduit means across the upstream and downstream ends of said heat exchange means for conducting a portion of said hot gaseous refrigerant around said heat exchange means and for mixing said portion of hot gaseous refrigerant with said low temperature gaseous refrigerant.

22. In a refrigeration system having compressor means, condenser means and evaporator means and including the normal refrigeration process of:

compressing gaseous refrigerant to a relatively high compressor discharge temperature and relatively high compressor discharge pressure, said compressor discharge temperature being substantially above saturation temperature of that refrigerant at the compressor discharge pressure;

condensing the compressed gaseous refrigerant to a liquid at substantially said compressor discharge pressure;

evaporating the liquid refrigerant at a substantially lower pressure than the compressor discharge pressure; and returning the evaporated refrigerant to the compressor to complete the normal closed cycle refrigeration process;

an improved defrosting method, comprising the steps of:

evaporating a portion of the liquid refrigerant in heat exchange relation with a portion of the gaseous refrigerant from the compressor discharge to reduce the temperature of said gaseous refrigerant portion substantially below said compressor discharge temperature at substantially the compressor discharge pressure;

mixing gaseous refrigerant at substantially the compressor discharge temperature with gaseous refrigerant at said reduced temperature before conducting the mixed gaseous refrigerant at a relatively moderate temperature between said compressor discharge and reduced temperature to said evaporator means to defrost same;

selectively passing said reduced temperature gaseous refrigerant portion through said evaporator means to defrost same by giving up heat to said evaporator means; and thereafter returning that refrigerant portion to the normal refrigeration cycle.

23. A method according to claim 22, further comprising:

controlling the flow of said liquid refrigerant portion in heat exchange relation to maintain said gaseous refrigerant portion at or above a desired temperature differential with the saturation temperature of that refrigerant at the compressor discharge pressure.

24. In a refrigeration system having compressor means, condenser means and evaporator means and including the normal refrigeration process of:

compressing gaseous refrigerant to a relatively high compressor discharge temperature and relatively high compressor discharge pressure, said compressor discharge temperature being substantially above saturation temperature of that refrigerant at the compressor discharge pressure;

condensing the compressed gaseous refrigerant to a liquid at substantially said compressor discharge pressure;

evaporating the liquid refrigerant at a substantially lower pressure than the compressor discharge pressure; and returning the evaporated refrigerant to the compressor to complete the normal closed cycle refrigeration process;

an improved defrosting method, comprising the steps of:

evaporating a portion of the liquid refrigerant in heat exchange relation with a portion of the gaseous refrigerant from the compressor discharge to reduce the temperature of said gaseous refrigerant portion substantially below said compressor discharge temperature at substantially the compressor discharge pressure;

measuring at least one of the temperature and pressure of the reduced temperature gaseous refrigerant portion; and controlling the flow of said liquid refrigerant portion into heat exchange relation with said gaseous refrigerant portion to maintain the temperature of the reduced temperature gaseous refrigerant portion at or above a desired value substantially lower than the compressor discharge temperature;

selectively passing said reduced temperature gaseous refrigerant portion through said evaporator means to defrost same by giving up heat to said evaporator means; and thereafter returning that refrigerant portion to the normal refrigeration cycle.

25. For use in refrigerating system comprising:

compressor means for compressing gaseous refrigerant to a relatively high temperature at a relatively high pressure; condenser means coupled to said compressor means for condensing said gaseous refrigerant to a liquid at said high pressure;

a plurality of evaporator means coupled in parallel for evaporating said liquid refrigerant at a relatively low pressure which is substantially lower than said high pressure; and suction means for returning evaporated refrigerant from said evaporator means to said compressor means; a defrosting arrangement comprising:

defrost conduit means for conducting gaseous refrigerant from said compressor means to said evaporator means at said high pressure;

means for reducing the temperature of the gaseous refrigerant in said defrost conduit means to an intermediate temperature substantially below the compressor discharge temperature of the gaseous refrigerant and substantially above the saturation temperature of the gaseous refrigerant at said pressure, said temperature reducing means including:

means for mixing compressed gaseous refrigerant at said compressor discharge temperature with compressed gaseous refrigerant at a relatively low temperature below said intermediate temperature before conducting the mixed gaseous refrigerant at said intermediate temperature to said evaporator means in the defrosting mode;

means for selectively connecting the low side of at least one of the evaporator means to one of said suction means and defrost conduit means depending on whether said at least one evaporator means is selected to be in a refrigerating mode or defrosting mode, respectively, whereby, in said defrosting mode, said intermediate temperature gaseous refrigerant is conducted to the selected at least one evaporator means to defrost same.

26. A defrosting arrangement according to claim 25, wherein said temperature reducing means comprises:

heat exchange coil means located in close physical proximity and in counterflow relation with at least a portion of said defrost conduit means; and means coupling the heat exchange coil means between the liquid side and the suction side of the refrigeration system, whereby liquid refrigerant is evaporated in said heat exchange coil means to remove heat from gaseous refrigerant in said portion of said defrost conduit means to thereby reduce the temperature of the gaseous refrigerant in said defrost conduit portion to said relatively low temperature.

27. A defrosting arrangement according to claim 26, further comprising: bypass conduit means connected to said defrost conduit means across the upstream and downstream ends of said heat exchange coil means for conducting a portion of said gaseous refrigerant at said compressor discharge temperature around said heat exchange coil means and for mixing said portion of gaseous refrigerant at the compressor discharge temperature with said relatively low temperature gaseous refrigerant to obtain said intermediate temperature gaseous refrigerant.

28. A defrosting arrangement for a refrigeration system having compressor means for compressing a refrigerant to a relatively high compressor discharge pressure, condenser means for condensing that compressed refrigerant to a liquid at substantially that relatively high pressure, evaporator means coupled between said condenser means and said compressor means to accomplish the desired normal refrigeration by evaporating that liquid refrigerant at a relatively low pressure and returning the thus formed gaseous refrigerant to the intake of the compressor means as a substantial heat load, said defrosting arrangement comprising:

defrost conduit means for selectively conducting gaseous refrigerant from the compressor discharge to the evaporator means for defrosting that evaporator means; and heat exchange means coupled between the liquid side and the suction side of the refrigeration system and in heat exchange relation with said defrost conduit means for removing heat from hot refrigerant gas passing through said defrost conduit means to the evaporator means, said heat exchange means acting as an additional load to absorb liquid refrigerant produced by the defrosting of said evaporator means;

wherein said heat heat exchange means comprises:

heat exchange coil means including a first heat exchange coil located in close physical proximity to and in counterflow relation with said defrost conduit means and a second heat exchange coil coupled in series with and downstream of the first heat exchange coil and located in close physical proximity to and in parallel flow relation with said defrost conduit means downstream of said first heat exchange means, and means coupling the heat exchange coil means between the liquid side and the suction side of the refrigeration system, whereby liquid refrigerant is evaporated in said heat exchange coil means to remove heat from gaseous refrigerant in said defrost conduit means to thereby reduce the temperature of the gaseous refrigerant in the defrost conduit means to a relatively low temperature before said gaseous refrigerant is conducted to the evaporator means to defrost same.

29. A defrosting arrangement for a refrigeration system having compressor means for compressing a refrigerant to a relatively high compressor discharge pressure, condenser means for condensing that compressed refrigerant to a liquid at substantially that relatively high pressure, evaporator means coupled between said condenser means and said compressor means to accomplish the desired normal refrigeration by evaporating that liquid refrigerant at a relatively low pressure and returning the thus formed gaseous refrigerant to the intake of the compressor means as a substantial heat load, said defrosting arrangement comprising:

defrost conduit means for selectively conducting gaseous refrigerant from the compressor discharge to the evaporator means for defrosting that evaporator means; and heat exchange means coupled between the liquid side and the suction side of the refrigeration system and in heat exchange relation with said defrost conduit means for removing heat from hot refrigerant gas passing through said defrost conduit means to the evaporator means, said heat exchange means acting as an additional load to absorb liquid refrigerant produced by the defrosting of said evaporator means;

wherein said heat exchange means comprises:

heat exchange coil means located in close physical proximity and in parallel flow relation with said defrost conduit means, and means coupling the heat exchange coil means between the liquid side and the suction side of the refrigeration system, whereby liquid refrigerant is evaporated in said heat exchange coil means to remove heat from gaseous refrigerant in said defrost conduit means to thereby reduce the temperature of the gaseous refrigerant in the defrost conduit means to a relatively low temperature before said gaseous refrigerant is conducted to the evaporator means to defrost same.

* * * * *